US005714965A

United States Patent [19]

Taguchi

[11] Patent Number: 5,714,965

[45] Date of Patent: Feb. 3, 1998

[54] ACTIVE RECEPTION ANTENNA WITH COPLANAR FEEDER

[75] Inventor: Mitsuo Taguchi, Kishima-Gun, Japan

[73] Assignee: Nippon Mektron, Ltd, Tokyo-To, Japan

[21] Appl. No.: 531,443

[22] Filed: Sep. 21, 1995

[30] Foreign Application Priority Data

Jan. 27, 1995 [JP] Japan ..... 7-011889

[51] Int. Cl.[6] ..... H01Q 7/00

[52] U.S. Cl. ..... 343/866; 343/701; 333/113

[58] Field of Search ..... 343/701, 741, 343/742, 743, 744, 700 MS, 795, 855, 858, 713; 333/113, 204

[56] References Cited

U.S. PATENT DOCUMENTS

| | | | |
|---|---|---|---|
| 4,459,595 | 7/1984 | Kramer et al. | 343/701 |
| 4,602,260 | 7/1986 | Lindenmeier et al. | 343/701 |
| 4,980,693 | 12/1990 | Wong et al. | 343/700 MS |
| 5,019,830 | 5/1991 | Harada | 343/701 |
| 5,138,330 | 8/1992 | Lindenmeier et al. | 343/701 |
| 5,469,180 | 11/1995 | Wiggenhorn | 343/741 |

FOREIGN PATENT DOCUMENTS

| | | | |
|---|---|---|---|
| 3234248 | 4/1984 | Germany | 343/713 |

OTHER PUBLICATIONS

"Antenna Engineering Handbook", Third Edition, Richard C. Johnson, Georgia Institute of Technology, Atlanta Georgia, McGraw-Hill, Inc. pp. 5-1—5-23.

*Primary Examiner*—Donald T. Hajec
*Assistant Examiner*—Tan Ho
*Attorney, Agent, or Firm*—Foley & Lardner

[57] ABSTRACT

An active reception antenna with a coplanar waveguide having a high actual gain in the frequency band as broad as 100% or larger of the central frequency. The reception active antenna with a coplanar waveguide has: a pair of coplanar waveguide functioning as a feeder, the coplanar waveguide including a center conductor and two ground conductors printed on one surface of a dielectric film; and an antenna element conductor connected to the coplanar waveguide, the antenna element conductor being printed on the surface of the dielectric film, wherein the feed points of the antenna element conductor are disposed near the ends of the feeder, an active circuit including a field effect transistor is mounted between the feed points and the ends of the feeder, the impedance of the antenna element conductor and the feeder is matched together, and a signal received by the antenna element conductor is amplified and supplied to the feeder.

4 Claims, 5 Drawing Sheets

ACTIVE RECEPTION ANTENNA WITH COPLANAR FEEDER

BACKGROUND OF THE INVENTION

1. Field of the Invention

The present invention relates to an antenna used for land mobile communications and satellite mobile communications, and more particularly to a printed antenna formed on a dielectric substrate or a wire antenna used for radio and television broadcast reception.

2. Description of the Related Art

As antennas used for these fields, an active slot dipole antenna with a coplanar waveguide formed on a dielectric substrate is known. This antenna is described in the magazine "Microwave and Optical Technology Letters", Vol.6, No.15, December, 1993, pp.856–857. This antenna has a combined structure of three conductive flat plates and a field effect transistor, such as shown in FIG. 5. This antenna is used in a 7 GHz band. The upper flat plate and lower two flat plates are electrically separated in terms of d.c. The lower two flat plates are spaced apart, and a center conductor is disposed in this space forming two slots. The center conductor and two lower flat plates constitute the coplanar waveguide. The gate G of the field effect transistor Q is connected to the upper flat plate, the source S is connected to the two lower flat plates, and the drain D is connected to the center conductor of the coplanar waveguide.

This antenna uses the coplanar waveguide as the feeder. Spurious radiation from the feeder is suppressed, and a voltage induced at the center of the slot dipole is amplified by the field effect transistor Q.

FIG. 6 is a graph showing the measured E-plane pattern of this antenna in the angle range from +90° to −90°. The co-polar pattern is indicated by a solid line, and the cross-polar pattern is indicated by a broken line. FIG. 7 is a graph showing the measured H-plane pattern in the angle range from +90° to −90°. The co-polar pattern is indicated by a solid line, and the cross-polar pattern is indicated by a broken line. FIG. 8 is a graph showing the absolute gain characteristics of the antenna having the structure shown in FIG. 5. As indicated by a solid line, this antenna has a gain of about 7 to 8 dB in the frequency range from 6.9 GHz to 7.6 GHz. A broken line in FIG. 8 indicates a pain of a standard horn antenna NARDA model 642, which is shown herein for reference.

The slot shape of a conventional antenna such as shown in FIG. 5 is modified in order to have an impedance matching between the slot device and the field effect transistor. Also in order to prevent a d.c. bias from being applied to the slot feed points, a complicated structure is utilized such as forming a fine slit in the direction of the slot central axis. Therefore, the frequency band of the antenna having such a basic structure is as narrow as about 10% of the center frequency.

SUMMARY OF THE INVENTION

An object of the present invention is to provide an active antenna with a coplanar waveguide having a high gain in the frequency band as broad as 100% or more of the center frequency.

According to one aspect of the present invention achieving the above object, there is provided an active reception antenna with a coplanar feeder comprising: a pair of coplanar waveguide functioning as a feeder, the coplanar waveguide including a center conductor and two ground conductors printed on one surface of a dielectric film; and an antenna element conductor connected to the coplanar lines, the antenna element conductor being printed on the surface of the dielectric film, wherein the feed points of the antenna element conductor are disposed near the ends of the feeder, an active circuit including a field effect transistor is mounted between the feed points and the ends of the feeder, the impedance of the antenna element conductor, the active circuit and the feeder is matched together, and a signal received by the antenna element conductor is amplified and supplied to the feeder.

The antenna element conductor hereinabove can be constructed as a lump antenna.

According to the structure of the invention, a pair of coplanar waveguide and an antenna element conductor are formed on one surface of a dielectric film by printing technique. The feed points of the antenna element conductor are disposed near the ends of the feeder, and the active circuit including the field effect transistor is mounted between the feed points and the ends of the feeder to provide an active element function. A signal received by the antenna element conductor is amplified and supplied to the feeder.

With the structure using the loop antenna, the loop antenna has the input impedance characteristics that change slowly over the operating frequency band. Therefore, by properly selecting the impedance, the impedance can be matched with that of the active circuit over the broader frequency band.

DETAILED DESCRIPTION OF THE PREFERRED EMBODIMENTS

Figure 1:
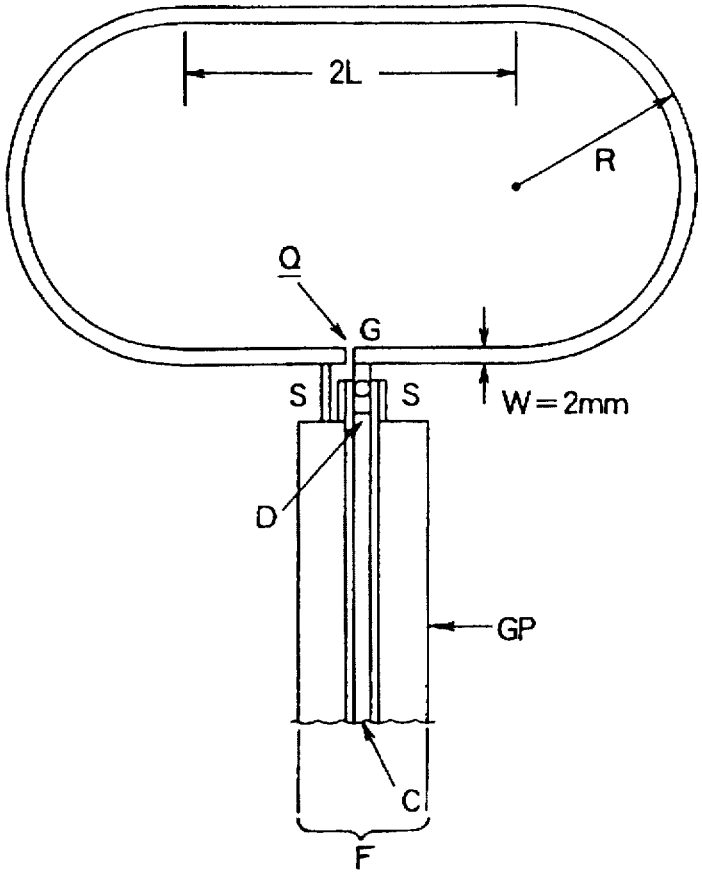
FIG. 1 is a plan view showing the structure of an antenna according to an embodiment of the invention.

FIG. 1 shows the structure of the antenna according to an embodiment of the invention. Referring to FIG. 1, this antenna ANT is a loop antenna having generally the ellipsoidal shape with arcs of a radius R at opposite ends and straight lines of a length 2 L at the central area. Feed points are formed at the center of one of the straight lines, and an active circuit inclusive of a field effect transistor Q is connected to the feed points. The active circuit is also connected to a pair of feeder F as coplanar waveguide consisting of a center conductor C and a ground conductor GP. The connections between the loop antenna and the active circuit and between the active circuit and the feeder will be described later with reference to FIG. 2.

This loop antenna ANT and feeder F are formed on the surface of a thin dielectric film of 45 μm thick, by printing technique. The frequency range is set to a TV broadcast frequency so that the arc radius R of the loop is 44 mm and the length L of the straight line is 0 to 4 cm. The characteristic impedance of the coplanar lines as the feeder is 75 Ω. The antenna may be coated with a film having a proper thickness, for example, about 50 μm, for the protection thereof.

Figure 2:
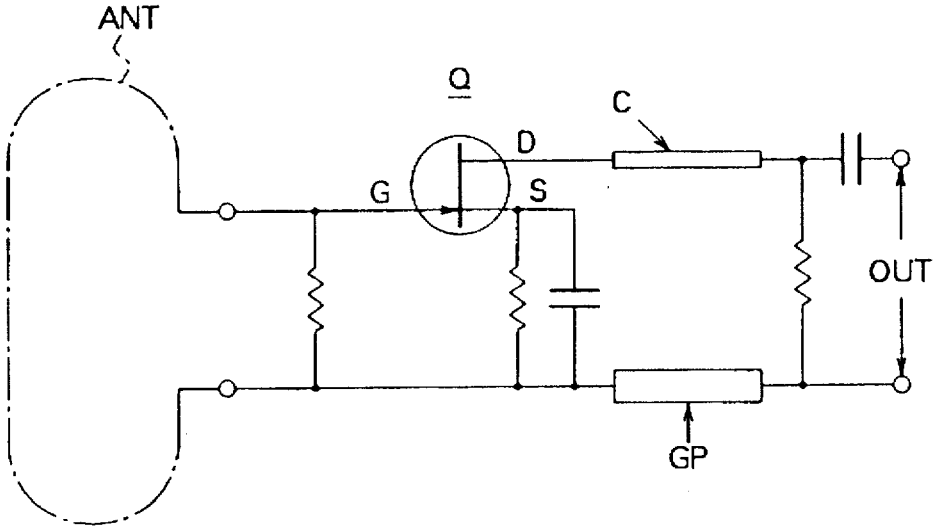
FIG. 2 is an equivalent circuit of the antenna shown in FIG. 1.

FIG. 2 is an equivalent circuit of the active circuit including the field effect transistor Q and its peripheral circuit. The field effect transistor Q is FHC30LG made of a GaAs type. The gate G is connected to one feed point of the loop antenna, the source S is connected via a resistor and a capacitor to a ground conductor GP connected to the other feed point of the loop antenna, and the drain D is connected to the center conductor. The gate G of the field effect transistor Q is connected via a resistor to the ground conductor GP. The available power gain of the field effect transistor Q is 17 to 18 dB in the frequency range from 100 MHz to 500 MHz.

A series circuit of a resistor and a d.c. power source is connected across the output side of the center conductor C of the feeder F and the ground conductor GP. The center conductor C is connected via a capacitor to one of the output terminals, and the other output terminal is connected to the ground conductor GP.

Figure 3A:
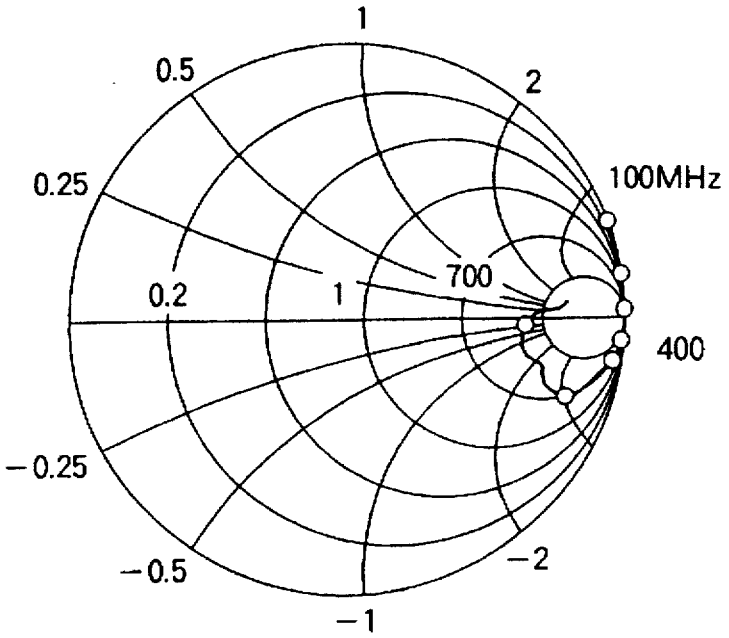
FIGS. 3(*a*) and FIG. 3(*b*) are an input impedance Smith chart of loop conductor and an S parameter Smith chart of the field effect transistor shown in FIG. 1, the charts being obtained from actual measurements.
Figure 3B:
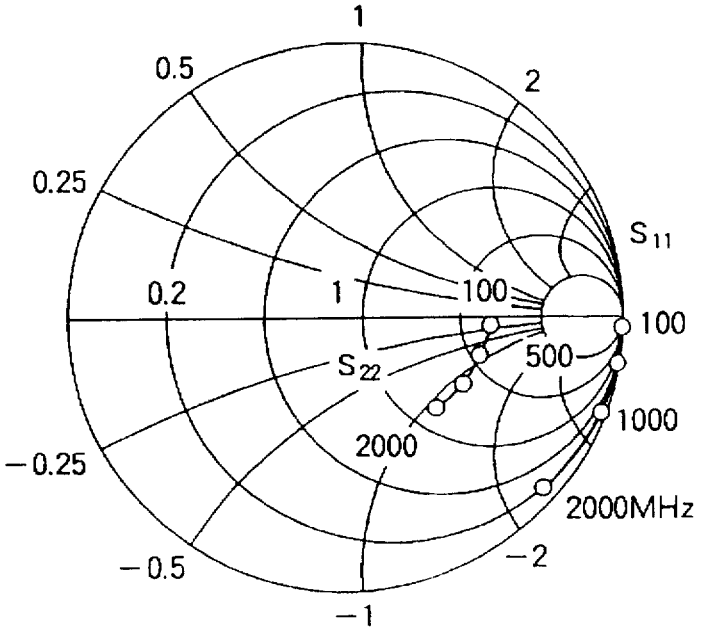

FIGS. 3(*a*) and 3(*b*) are an input impedance Smith chart of the embodiment antenna and a scattering parameter Smith chart of the field effect transistor used as the active element, respectively normalized by the characteristic impedance of 50 Ω, the charts being obtained from actual measurements.

The input impedance shown in FIG. 3(*a*) and the S11 parameter shown in FIG. 3(*b*) are generally matched over the broad band on the low frequency side. The S22 parameter of the transistor has a value near 75 Ω, which is the characteristic impedance of the coplanar waveguide, over the whole band of the television broadcast.

The conjugate impedance matching is therefore ensured between the loop antenna, field effect transistor, and coplanar lines. Accordingly, a signal received by the loop antenna is supplied to and amplified by the field effect transistor with small reflection at the connection points between the loop antenna and the field effect transistor, and further transmitted to the coplanar waveguide with small reflection at the connection points between the field effect transistor and the coplanar waveguide. The antenna has therefore a broad bandwidth and a high gain.

Figure 4:
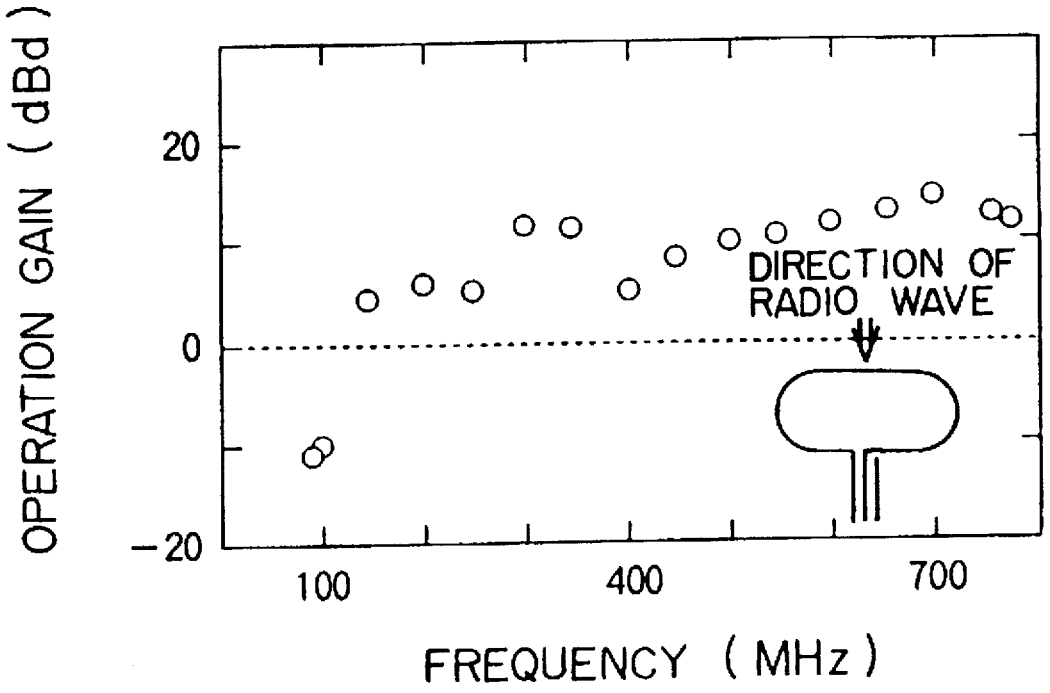
FIG. 4 is a graph showing the frequency characteristics of the actual gain of the antenna shown in FIG. 1.
Figure 5:
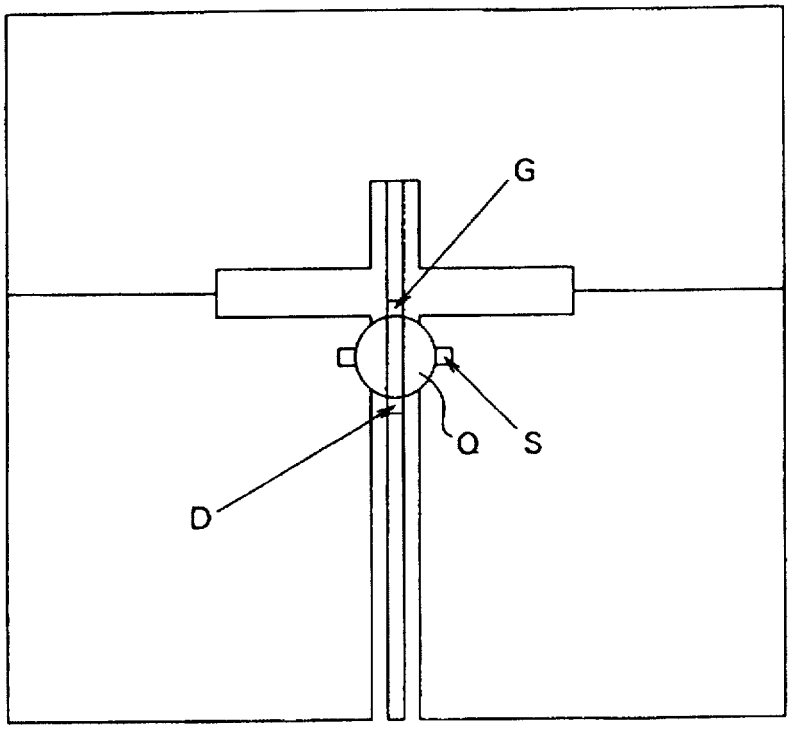
FIG. 5 is a plan view showing the structure of an active slot dipole antenna with a coplanar waveguide.
Figure 6:
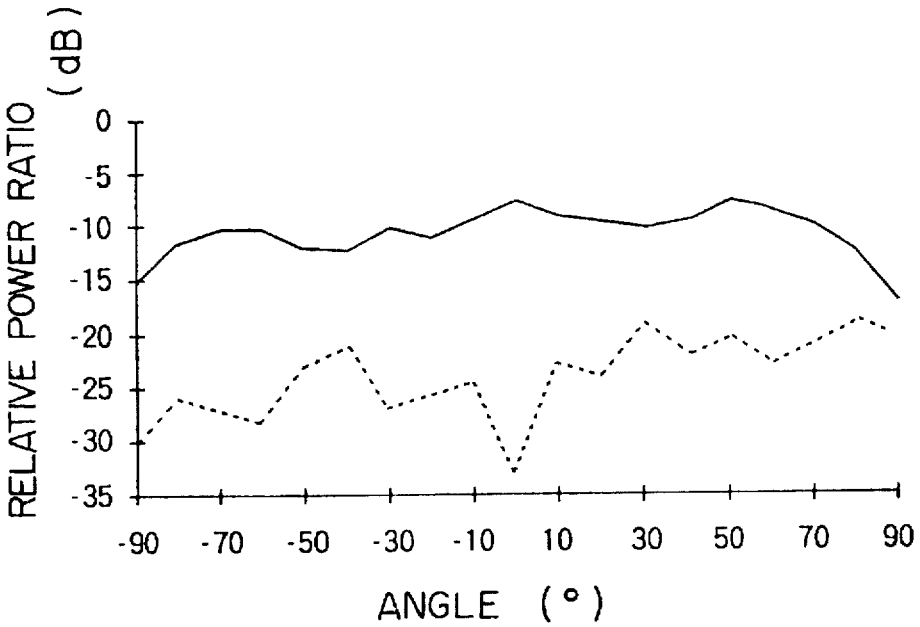
FIG. 6 is a graph showing the measured co-polar and cross-polar patterns in the angle range from +90° to −90° in the E-plane, respectively of the antenna shown in FIG. 5, the co-polar pattern being by a solid line, and the cross-polar pattern being by a broken line.
Figure 7:
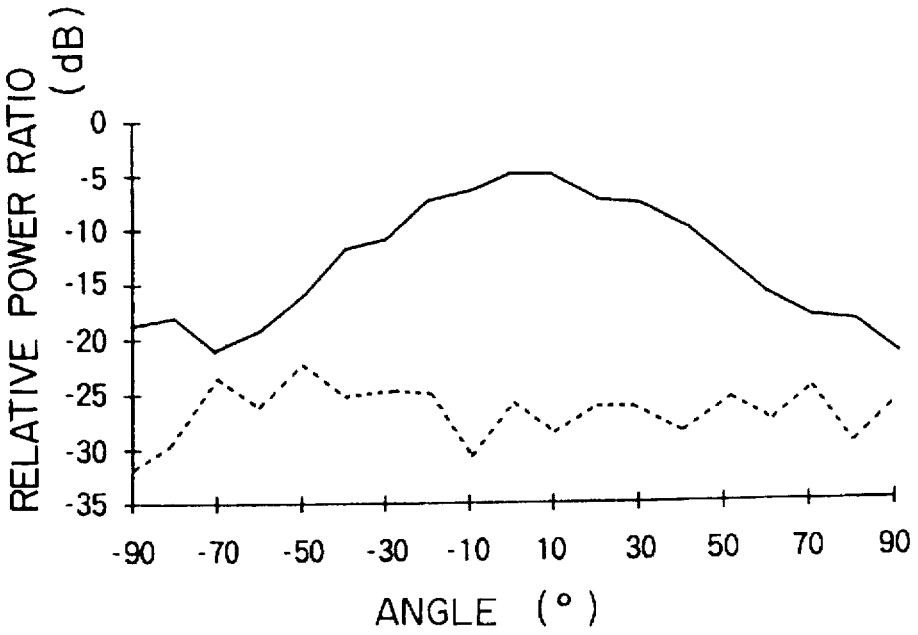
FIG. 7 is a graph showing the measured co-polar and cross-polar patterns in the angle range from +90° to −90° in the H-plane, respectively of the antenna shown in FIG. 5, the co-polar pattern being by a solid liner and the cross-polar pattern being by a broken line.
Figure 8:
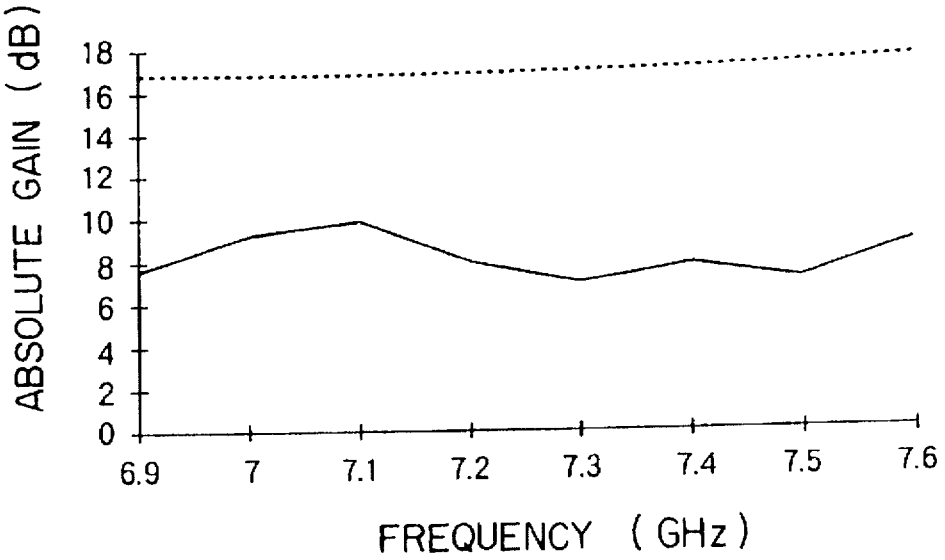
FIG. 8 is a graph showing the absolute gain characteristics of the antenna having the structure shown in FIG. 5.

FIG. 4 is a graph showing the measured values of the actual gain of an active antenna, for the comparison with a standard half wave dipole antenna, the antenna having a straight line length of L=4 cm and the radio wave being incident in the front direction of the antenna. As seen from each plotted measurement value of FIG. 4, although the gain is low for VHF1 to VHF3 channels (frequency from 90 to 108 MHz), an actual gain of 4 dB or higher is obtained for VHF4 to VHF12 channels (frequency from 170 to 222 MHz), and a, high gain of 8 dB or higher is obtained for UHF channels (frequency from 470 to 770 MHz).

A received television signal has no distortion even for a high electric field.

What is claimed is:

1. An active reception antenna comprising:

a pair of coplanar waveguides functioning as a feeder, said coplanar waveguides including a center conductor and two ground conductors printed on one surface of a dielectric film; and an antenna element conductor connected to said coplanar waveguides, said antenna element conductor being printed on the surface of said dielectric film and having a positive reactance and a lower gain at a lower frequency range than at a higher frequency range, wherein feed points of said antenna element conductor are disposed near the ends of said feeder, an active circuit including a field effect transistor is mounted between the feed points and the ends of said feeder, and said field effect transistor has a negative input reactance to ensure conjugate impedance matching with said antenna element conductor at the lower frequency range so that the impedance of said antenna element conductor and said feeder is matched together at the lower frequency range and a signal received by said antenna element conductor is amplified and supplied to said feeder for the lower frequency range and a higher frequency range.

2. An active reception antenna comprising:

a pair of coplanar waveguides functioning as a feeder, the coplanar waveguides including a center conductor and two ground conductors printed on one surface of a dielectric film;

an antenna element conductor connected to the coplanar waveguides and printed on the surface of the dielectric film, the antenna element conductor having a positive input reactance substantially over a VHF channel frequency range, wherein feed points of the antenna element conductor are disposed near the ends of the feeder; and an active circuit, including a field effect transistor, mounted between the feed points and the ends of the feeder, the field effect transistor having a negative input reactance substantially over at least the VHF channel frequency range to ensure conjugate impedance matching with the antenna element conductor over the VHF channel frequency range, wherein the active circuit amplifies a signal received by the antenna element conductor and supplied to the feeder for the VHF channel frequency range and a UHF channel frequency range.

3. An active reception antenna according to claim 2, wherein the field effect transistor has a gate connected to one of the feed points, a source connected to the two ground conductors through a resistor and a capacitor, and a drain connected to the center conductor.

4. An active reception antenna according to claim 2, wherein the antenna element conductor has a positive input reactance over the VHF channel frequency range of about 100 MHz to 300 MHz.

* * * * *